United States Patent [19]

Kaley et al.

[11] Patent Number: 4,950,186

[45] **Date of Patent: * Aug. 21, 1990**

[54] ELECTRICAL CONTACT TERMINAL

[75] Inventors: Robert C. Kaley, Landisville; James H. Wise, Palmyra, both of Pa.

[73] Assignee: AMP Incorporated, Harrisburg, Pa.

[ * ] Notice: The portion of the term of this patent subsequent to Jun. 12, 2007 has been disclaimed.

[21] Appl. No.: 366,817

[22] Filed: Jun. 15, 1989

Related U.S. Application Data

[63] Continuation-in-part of Ser. No. 285,681, Dec. 15, 1988, abandoned, and a continuation-in-part of Ser. No. 359,196, May 31, 1989.

[51] Int. Cl.[5] ..... H01R 4/18

[52] U.S. Cl. ..... 439/882; 439/883

[58] Field of Search ..... 29/863–866; 439/856, 857, 865–868, 877–882, 883

[56] References Cited

U.S. PATENT DOCUMENTS

| | | | |
|---|---|---|---|
| 2,535,013 | 12/1950 | Freedman | 173/269 |
| 2,704,358 | 3/1955 | Wells . | |
| 3,141,724 | 7/1964 | Raymond | 339/256 |
| 3,295,094 | 12/1966 | DeLyon . | |
| 3,521,224 | 7/1970 | Spooren . | |
| 3,538,239 | 11/1970 | Renshaw, Jr. . | |
| 3,569,919 | 3/1971 | Daddona, Jr. | 439/848 |
| 3,699,504 | 10/1972 | Huber . | |
| 3,977,757 | 8/1976 | Yurtin | 339/217 |
| 4,142,771 | 3/1979 | Barnes et al. . | |
| 4,150,355 | 4/1979 | Neff et al. . | |
| 4,371,229 | 2/1983 | Spangler et al. . | |
| 4,692,122 | 9/1987 | Montalbano . | |

FOREIGN PATENT DOCUMENTS

| | | | |
|---|---|---|---|
| 2438359 | 10/1979 | France . | |
| 516640 | 1/1940 | United Kingdom | 439/883 |

*Primary Examiner*—Gary F. Paumen
*Attorney, Agent, or Firm*—Katherine A. Nelson

[57] ABSTRACT

A wire-receiving barrel terminal comprises first and second terminal portions 12, 32, which together define a dual contact portion 76, dual transition portion 78 and double barrel portion 80. The first and second terminal portions 12, 32, each include respective at least one contact section 14, 36, respective transition portions 16, 60 being joined integrally with and extending rearwardly from the corresponding at least one first contact section 14, 36 respectively and respective barrel sections 18, 62, joined integrally with and extending rearwardly from the respective transition portions 16, 60. The first barrel section 18 being joined integrally with and extending from said second barrel section 62, the first and second barrel sections 18, 62 being generally rectangular, each having at least one lateral edge 24, 70 and a respective lateral dimension at least equal to the circumference of a circle of a desired wire-receiving barrel inner diameter. The first barrel section 18 is formed into a barrel-shaped member 30 having its axis parallel to the at least one respective lateral edge of the first barrel section 18 and the second barrel section 62 is formed circumferentially around and adjacent the first barrel section defining a wire-receiving barrel having inner and outer walls. After forming terminal 10, first contact section 14 and first transition portion 16 extend respectively along second contact section 36 and second transition portion 60 thereby defining dual contact portion 76, and dual transition portion 78, respectively. The resulting wire-receiving barrel has substantially two wall thicknesses circumferentially therearound with no open seam and the two transition portions 16, 60 provide a plurality of contact paths for current passed through said terminal.

4 Claims, 3 Drawing Sheets

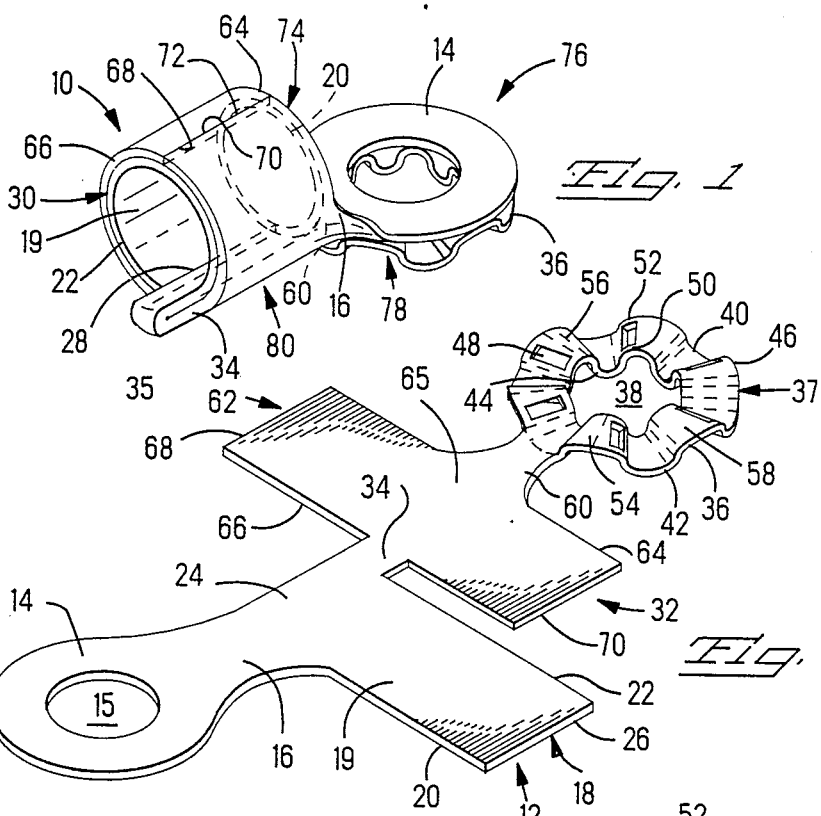
Fig. 1
Fig. 2
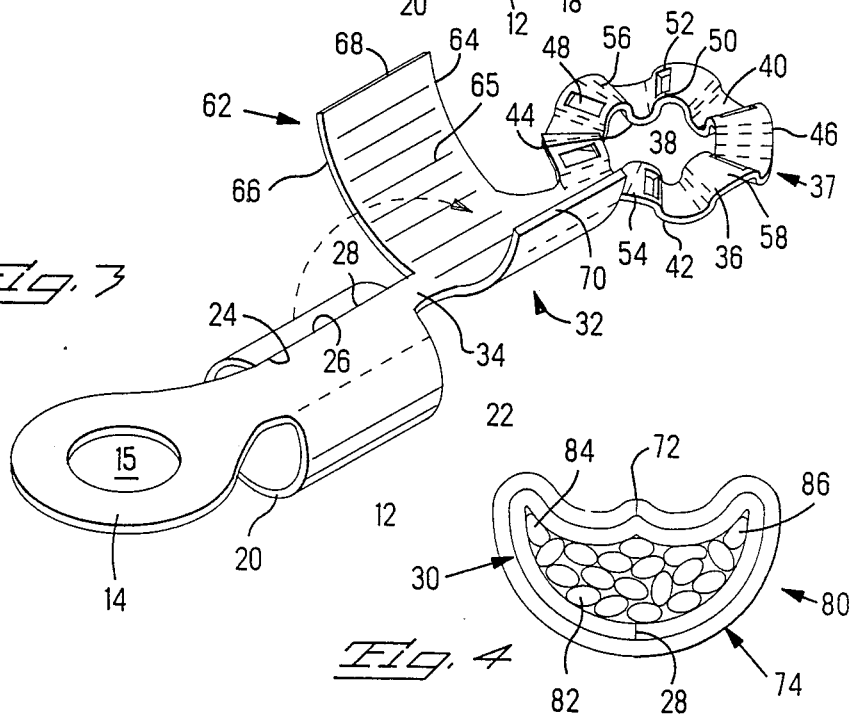
Fig. 3
Fig. 4

ELECTRICAL CONTACT TERMINAL

RELATED APPLICATIONS

This application is a continuation-in-part of U.S. patent application Ser. No. 07/285,681, filed Dec. 15, 1988, now abandoned and continued in U.S. patent application Ser. No. 07/376,978, and of U.S. patent application Ser. No. 07/359,196, filed May 31, 1989; both of which are owned by the present assignee.

FIELD OF THE INVENTION

This invention is directed to electrical contact terminals and in particular to a wire-receiving barrel type electrical terminals that may be stamped and formed.

BACKGROUND OF THE INVENTION

In forming power or signal distribution systems it is necessary to provide interconnection between various members or components of the system. Typically the interconnections are provided by electrical connectors having one or more electrical contact terminals therein. Frequently the electrical terminals will be of the barrel type for termination to wire conductors. Generally it is desirable that these barrel terminals be crimpable to their associated wires. Furthermore, it is also desirable that the terminals be made in a cost effective manner such as by stamping and forming. Having an "open" seam in a barrel, however, can cause problems associated with stress relaxation in that when the terminal is crimped, the forces exerted outwardly along the seam of the crimped terminal may cause the seam to open, thus increasing the electrical resistance through the termination.

U.S. Pat. 2,704,358 discloses a contact of the prior art used for power systems having a solid barrel portion, a transition portion and a contact area. The width of the material used in the transition area between contact area and the barrel portion is narrow. The current flowing through this contact area therefore must flow through the narrow transition portion and into the larger body and contact area, thus raising the resistance and thereby the temperature in he transition portion. The very small cross sectional area of the transition portion of the contact terminal in effect may act as a fuse because it can overheat. It is desirable, therefore, to provide a contact terminal or member that will have an essentially constant cross sectional area throughout the length of the terminal.

U.S. Pat. 2,535,013 discloses a connector having a crimpable power contact terminal having a solid barrel portion made by brazing the seam of a formed member. Other methods for achieving essentially solid barrel terminals include the use of a separate sleeve disposed over the formed terminal or by use of a machined part. Both of these aforementioned methods increase the number of manufacturing steps and, therefore, the cost of the terminal.

U.S Pat. 2,535,013 discloses a method of crimping barrel type terminals that is designed to be used with a single annular ring such as a solid screw machined part or a formed member having a brazed seam. When the barrel is crimped it is subjected to sufficient pressure that the outer surface undergoes plastic deformation and is essentially locked into place and, therefore, does not stress relax enough to effect the function of the crimped barrel.

U.S. application Ser. No. 07/285,681, now abandoned and continued in U.S. Patent application Ser. No. 07/376,978 one of the parents of the present application, discloses an electrical contact terminal comprised of a hollow body portion having a plurality of contact sections extending forwardly therefrom, a double layer wire barrel portion and first and second opposing transition portions that extend between the barrel portions and the body portions. The double barrel portion includes inner and outer barrel sections, the first barrel section being nested within the second barrel portion such that a seam of the first barrel section is basically diametrically opposed from the seam of the second barrel section. The double barrel portion, therefore, simulates a continuous annular body that will act in essence as a solid member for crimping without requiring brazing or joining of the seam or a separate solid sleeve member disposed over the seam.

U.S. application Ser. No. 07/359,196, the other parent of the present application discloses a method for making a double barrel portion for a ring-type terminal or other electrical terminal having only a single transition portion between the barrel and the contact portion of the terminal, the double barrel portion being crimpable and acting in essence as a solid member as previously described. It is also desirable, however, to have a ring-type electrical terminal member having a double barrel crimpable portion and a dual transition portion for providing parallel paths for electrical current when the terminal is under load.

SUMMARY OF THE INVENTION

In accordance with the present invention, an electrical terminal is disclosed that alleviates the disadvantages and deficiencies of the prior art, can be stamped from a sheet of stock metal, and furthermore provides an electrical contact terminal that provides contact paths for distributing the current between two electrical articles It is an object of the invention to provide a terminal that has a barrel portion that is stamped and formed but has a construction that is essentially equivalent to that of a solid barrel member.

It is also an object of the invention to provide a terminal having a barrel portion that is crimpable.

It is an additional object of the invention to provide an electrical terminal member that effectively has no open seam.

It is a further object of the invention to provide a cost effective method for making electrical contact terminals having a crimpable barrel section.

The present invention is directed to an electrical contact terminal that is stamped and formed from a single thickness of metal stock having first and second terminal portions defining a double contact portion, a double barrel portion and a double transition portion extending therebetween. The first terminal portion includes at least one first contact section, a first transition portion being joined integrally with and extending rearwardly from the at least one first contact section and a first barrel section being joined integrally with and extending rearwardly from the first transition portion The second terminal portion includes at least one second contact section, a second transition portion being joined integrally with and extending rearwardly from the at least one second contact section and a second barrel section being joined integrally with and extending rearwardly from the second transition portion, the first barrel section being joined integrally with and extending from the second barrel section. The first and second barrel sections are generally rectangular with each having at least one lateral edge and a respective lateral dimension at least equal to the circumference of a circle of a desired wire-receiving barrel inner diameter. The first barrel section is formed into a barrel-shaped member having its axis parallel to the at least one respective lateral edge of the first barrel section. The second barrel section is formed circumferentially around and adjacent the first barrel section defining a wire receiving barrel having inner and outer walls, each of the at least one lateral edge of the first and second barrel sections being disposed along a continuous wall portion of the other one of the first and second barrel sections. The double barrel portion is formed such that the first contact section and the first transition portion extend along the second contact section and the second transition portion respectively with the first contact section adjacent and overlying the second contact section, The first and second contact sections are adapted to be connected to a first electrical article. The resulting wire-receiving barrel has substantially two wall thicknesses circumferentially therearound with no open seam and the two transition portions provide a plurality of contact paths for current passed through the terminal.

In a first embodiment the first and second barrel sections are initially rectangular plates. The first and second barrel sections have respective first and second forward and rearward edges and lateral edges abutting at respective first and second seams. The first and second terminal portions are joined by a bight section which is integrally joined with and extends between the respective rearward edges of the first and second barrel sections. In this embodiment the first barrel section is substantially offset from the second barrel section and the first contact section extends from the forward edge thereof proximate the lateral edge essentially adjacent the bight section. After forming the first barrel section into a barrel shaped member having lateral edges thereof abutting at a first seam, the member is disposed along an adjacent and major surface of the second barrel section by bending at the bight section such that the first seam is disposed intermediate the lateral edges of the second barrel section and the first and second terminal portions extend along one another with the first contact section adjacent and overlying the second contact section. The second barrel section is then formed into an outer member to extend circumferentially around and adjacent the outer surfaces of the barrel shaped member with the lateral edges of the outer member abutting at a second seam that is essentially diametrically opposed from the first seam.

In a second embodiment the first barrel section is joined integrally with and extends laterally from the second barrel section. The first and second barrel sections are generally rectangular and conclude in respective first and second lateral edges. The first barrel section has a lateral dimension essentially equal to the circumference of a circle of the desired wire-receiving barrel inner diameter. The second barrel section has a lateral dimension essentially equal to the intended outer circumference of the desired barrel. First and second transition portions extend outwardly from the same rectangular edge, each transition portion being located at essentially the middle of the of the respective lateral dimension associated with the corresponding first and second barrel sections. First barrel section is formed into a barrel-shaped member by rolling with the first lateral edge of the first barrel section disposed adjacent a surface of the second barrel section and the barrel-shaped member having its axis parallel to the first lateral edge. The second barrel section is formed circumferentially around and adjacent the first barrel section defining a spiral wire-receiving barrel having inner and outer walls. The forming steps are defined by the locating of the first and second lateral edges along a continuous wall portion of the spiral wire receiving barrel. The resulting barrel has substantially two wall thickness circumferentially therearound with no open seam and the corresponding first and second contact sections and transition portions are adjacent and overly one another.

The invention is further directed to a method for stamping and forming the terminal from a single layer of metal stock.

The invention itself, together with further objects and its intended advantages, will be best understood by reference to the following detailed description taken in conjunction with the following drawings.

BRIEF DESCRIPTION OF THE DRAWINGS

FIG. 1 is a perspective view of the terminal made in accordance with the invention.

FIG. 2 is a flat plan view of a terminal blank used in making a terminal of FIG. 1.

FIG. 3 is a perspective view of a partially formed terminal made from the blank of FIG. 2.

FIG. 4 is a fragmentary cross sectional view illustrating a conductor terminated in the barrel portion of terminal of FIG. 1.

DETAILED DESCRIPTION OF THE DRAWINGS

Figure 9:
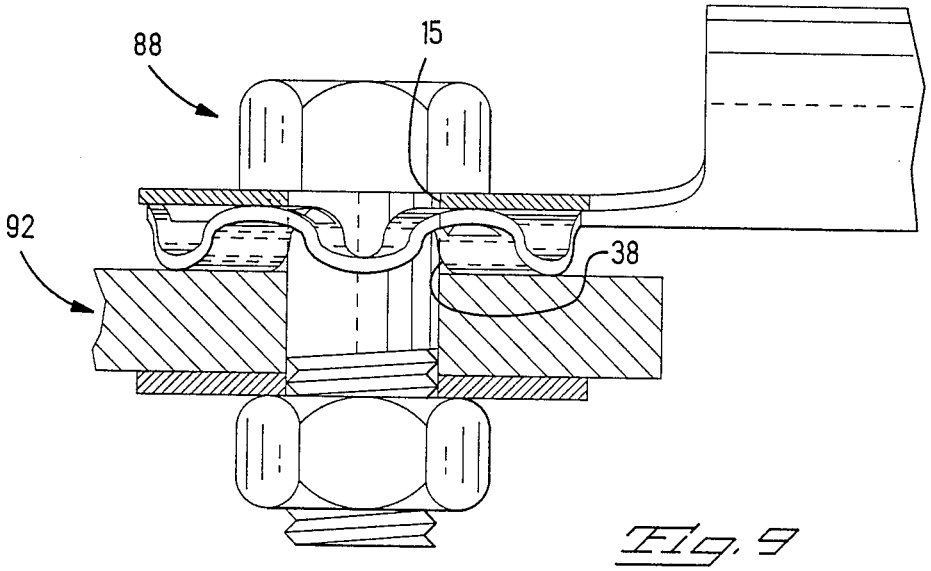
FIG. 9 is a fragmentary cross sectional view of the terminal of FIG. 1 mounted to a first electrical article.

Referring now to FIGS. 1 and 4, electrical terminal member 10 comprises first and second terminal portions 12, 32, which together define a double barrel portion 80, dual contact portion 76 and a dual transition portion 78. The first terminal portion 12 includes a first contact section 14 and a first or inner barrel shaped member 30 having opposed forward and rearward edges 20, 22 and opposed lateral edges 24, 26 abutting at a first seam 28. The first barrel shaped member 30 is joined integrally with and to the first contact section 14 by a first transition section 16. First transition section 16 extends forwardly from the forward edge 20 of the first or inner barrel shaped member 30. For purposes of illustrating the invention, the contact section is being shown as a ring-shaped member. It is to be understood that the contact section may be made or may have a different number of configurations such as a blade member, a ring tongue, spade lug or a form member such as a wave washer as shown in FIG. 1 and as disclosed in U.S. Patent application Ser. No. 07/359,240, filed May 31, 1989. The second terminal portion 32 includes a second contact section 36, a second or outer barrel shaped member 74 having opposed forward and rearward edges 64, 66 and opposed lateral edges 68, 70 abutting at a second seam 72. The second or outer barrel shaped member 74 is joined integrally with and to second contact section 36 by a second transition section 60, which extends forwardly from the forward edge 64 of the second barrel shaped member 74. First and second terminal portions 12, 32 are joined integrally with and extend from a bight section 34. Bight section 34 extends rearwardly from and between respective rearward edges 22, 66 of first and second barrel shaped members 30, 74 with the bight section 34 being bent back upon itself at 35 such that the first and second terminal portions 12, 32 extend along one another with the first contact section 14 adjacent and overlying the second contact section 36 to form the dual contact means 76. First and second contact sections 14, 36 are adapted to be connected to a first electrical article as shown in FIG. 9. As best seen in FIG. 1, in formed terminal 10, first transition section 16 is adjacent and overlies second transition section 60 to form the double transition portion 78 and second barrel shaped member 74 extends circumferentially around and adjacent the first barrel shaped member 30 such that the second seam 72 is essentially diametrically opposed from first seam 28 and a continuous portion of the second barrel shaped member 74 overlies the first seam 28.

FIGS. 2 and 3 illustrate terminal blank 11 used for forming the above terminal and a partially formed terminal respectively. As can best be seen in FIGS. 1 and 4, first and second barrel shaped members 30, 74 are formed from first and second barrel sections 18, 62, which are essentially rectangular plates. The second contact section 36 extends from edge 64 of second barrel section 62 intermediate the lateral edges 68 and 70 and the first contact section 14 extends outwardly from first barrel section 18 approximate 24, one of its lateral edges. FIG. 2 also shows that the first barrel section 18 is substantially offset from second barrel section 62 at the bight section 34. First and second contact sections 14, 36 extend from respective forward edges 20, 64 of corresponding barrel sections 18, 62 such that the contact sections 14, 36 lie along the axial center line of terminal 10 so that when terminal 10 is formed the first contact section 14 will overlie the second contact section 36 and first transition portion 16 will overlie second transition portion 60. FIG. 3 illustrates a partially formed terminal in which first barrel section 18 has been formed into a barrel shaped member 30 having the respective lateral edges 24, 26 disposed along a seam 28. As indicated by the arrow, the first or inner barrel member 30 is disposed along an adjacent major surface 65 of the second barrel section by bending bight section 34 at 35 such that seam 28 of first barrel shaped member 30 is disposed intermediate the lateral edges 68, 70 of the second barrel section 62. The second barrel section 62 is then formed into an outer barrel shaped member 74, which extends circumferentially around an adjacent outer surface of inner barrel shaped member 30. The lateral edges 68, 70 of second barrel section 62 abut at a second seam 72, which essentially diametrically opposed from seam 28. As can be seen from FIGS. 1 and 4, a continuous portion of the outer barrel member 74 extends or overlies the seam 28 of the inner barrel member 30 and a continuous portion of the inner barrel member 30 underlies outer barrel seam 72. By positioning the seams 28 and 72 on opposite sides of the assembled double barrel portion 80, the double barrel portion 80 functions essentially as a solid barrel when it is crimped.

In the assembled connector of FIG. 1, first transition portion 16 overlies the second transition portion 60 to form dual transition portion 78. The respective transition portions 16, 60 extend between a respective barrel shaped members 30, 74 and a corresponding respective one of the first and second contact sections 14, 36. The dual transition portion 78 provides parallel paths for current passing through terminal 10. In order to assure that the parallel paths are provided, it is important that there is an equally low resistance between inner barrel shaped section 30 and the outer barrel section 74 as there is between a wire conductor 80, as shown in FIG. 4, and the inner barrel shaped member 30. It is important, therefore, that all surfaces of the inner and outer barrel members 30, 74 remain in physical and electrical engagement so that parallel paths having essentially an equal resistance are presented by the inner and outer sections of double barrel portion 80 and through the respective transition portions to the respective first and second contact sections 14, 36. Since electricity will follow the path of least resistance, the alternate paths to the two transition areas would essentially therefore provide equally available paths for the electricity. One such way of assuring good engagement between the respected barrel surfaces is to put a plurality of serrations on at least one surface of the barrel shaped members 30, 74 that are engagement with each other. Preferably the serrations run axially on the inner surface, shown as 65 of outer barrel section 62, to provide a plurality of contact surfaces between the formed barrel members. In addition, the inner barrel surface 19 of the inner barrel member 30 may also include serrations for assuring better cold welding of wire 80 in inner barrel member 30. Since parallel current paths are presented for the current to flow from the wire through either the inner or outer barrel members through the respective transition portion to the respective contact sections, the present invention eliminates the "fuse-like" transition portion of the prior art.

Preferably terminals 10 are made from a continuous strip of metal which a plurality of terminal blanks are stamped in a configuration represented in FIG. 2. The first barrel section 18 is formed into inner barrel member 30 and the outer barrel section 62 is preferably formed into a partial U-shaped member in a manner similar to that described in parent application U.S. Serial No. 07/359,196. Bight section 34 is then folded at 35 such that inner barrel member 30 overlies outer barrel section 62 and first contact section 14 overlies second contact section 36.

As shown in FIG. 1 and 9, the first end contact sections 14, 36 need not be identical. In the embodiment shown, the first contact section 14 is a flat ring member which overlies second contact section 36, shown for example as an annular member 37. The details of annular member 37 and other such members are discussed in U.S. Patent Serial No. 07/359,240. The annular member 37 has a centrally disposed fastening receiving aperture 38 extending therethrough from opposed first and second major surfaces 40, 42 and an inner edge 44 adjacent the fastening aperture 38 and an outer edge 46 extending circumferentially therearound. The annular member 37 further includes a plurality of slots 48 spaced around extending from an integral strap section 50 along the inner edge 44 and a second integral strap section 52 along the outer edge 46, the slots 48 defining therebetween respective spring sections 54 in an annular array. Each of the spring sections 54 have a respective protrusion 56 extending outwardly from the first major surface 40 with each protrusion 56 further including a crest portion 58. As shown in FIGS. 1 and 9, the flat surface of second contact portion 36 overlies the crest portions 58 of the annular member. Upon applying a fastening means 88, as shown in FIG. 9, through corresponding fastener receiving apertures 15, 38 of first and second contact sections 14, 36, the first contact section 14 acts as a biasing means against the second contact section 36 thereby compressing the spring sections 54 and establishing contact normal force with the electrical article or between a first electrical article and the first and second contact surfaces thus establishing a plurality of electrical paths in parallel between the first article 92 and first and second sections 14, 36. Since a biasing means for second contact section 36 is part of terminal member 10, a separate washer need not be used in assembling and securing a terminal member to a first electrical article 92.

Figure 5:
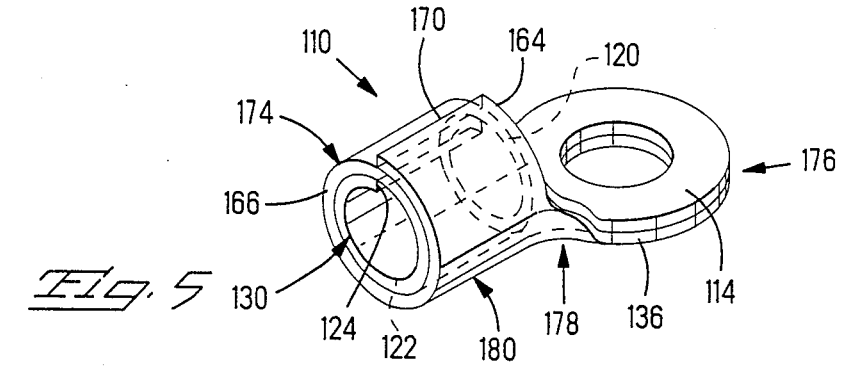
FIG. 5 is a perspective view of an alternative embodiment of the terminal made in accordance with the invention.

FIG. 5 illustrates alternative embodiment 110 of an electrical terminal member comprising first and second terminal portions 112, 132 defining a double barrel portion 180, dual contact portion 176 and a dual transition portion 178. The first terminal portion 112 includes a first contact section 114 and a first or inner barrel shaped member portion 130 having opposed forward and rearward edges 120, 122 and lateral edge 124. The first barrel shaped portion 130 is joined integrally with and to the first contact section 114 by a first transition section 116. First transition section 116 extends forwardly from the forward edge 120 of the first or inner barrel shaped portion 130. The second terminal portion 132 includes a second contact section 136, a second or outer barrel shaped member or portion 174 having opposed forward and rearward edges 164, 166 and lateral edge 170. The second or outer barrel shaped portion 174 is joined integrally with and to second contact section 136 by a second transition section 160, which extends forwardly from the forward edge 164 of the second barrel shaped member 174.

The essential difference between terminal embodiment 10 and alternative embodiment 110 is in the structure of double barrel portion 180. In embodiment 110, first and second barrel sections 118, 162 extend continuously along an essentially rectangular plate 63 having opposed lateral edges 124, 170. The lateral length of the rectangular rearward portion 63 is approximately two times the intended circumference of the wire-receiving barrel to be formed. First barrel section 118 extends from lateral edge 124 a distance equal to the length of the intended inner circumference $C_1$ of the inner barrel portion and second barrel section 162 extends along plate 63 for a distance equal to the length of the intended outer circumference $C_2$ of the outer barrel. First transition portion 116 extends forwardly from first forward contact edge 120 at a distance $D_1$, which is essentially equal to one-half of the intended inner barrel circumference and second transition portion 160 extends forwardly from second forward contact edge 164 at a distance $D_2$, which is essentially equal to one-half of the intended outer barrel circumference.

Figure 6:
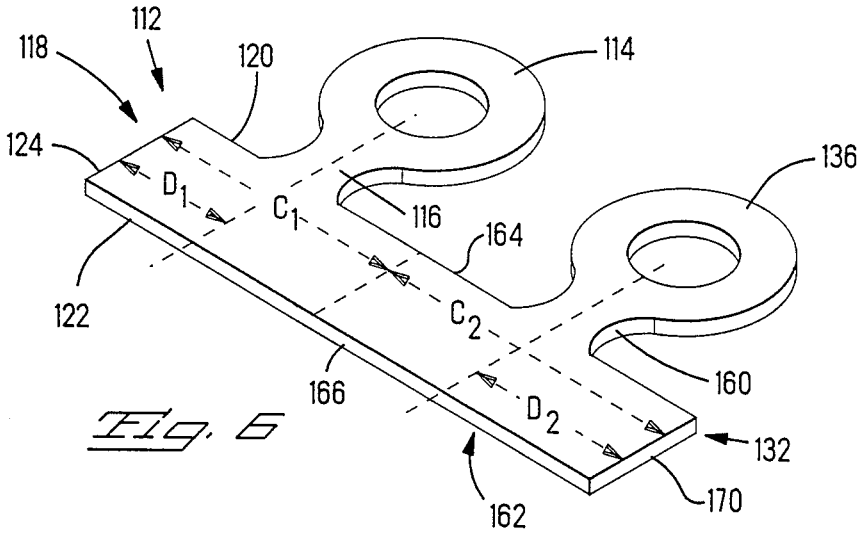
FIG. 6 is a flat plan view of a terminal blank used in making a terminal of FIG. 5.
Figure 7:
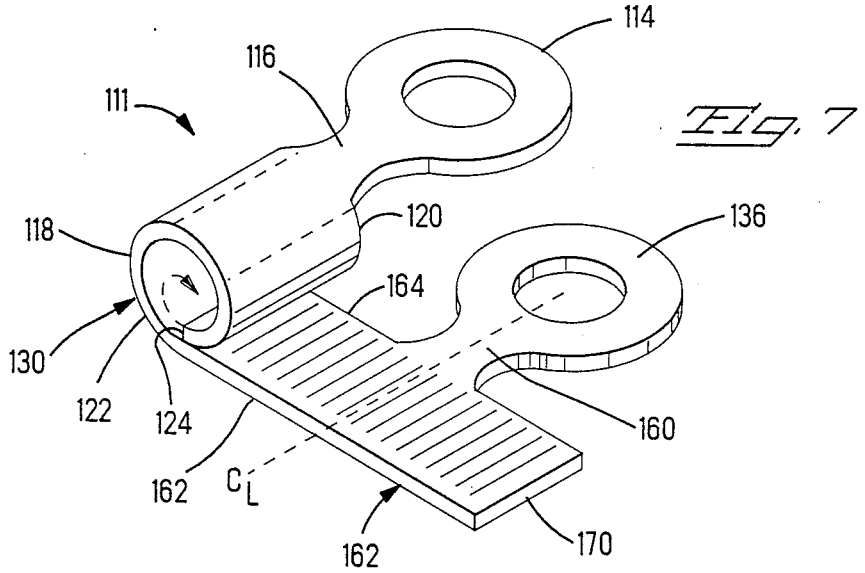
FIG. 7 is a perspective view of a partially formed terminal made from the blank of FIG. 5.
Figure 8:
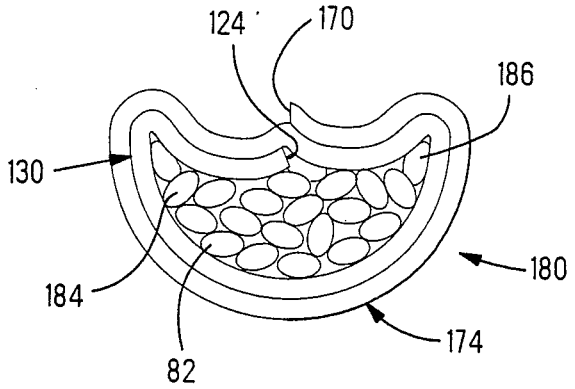
FIG. 8 is a fragmentary cross sectional view illustrating a conductor terminated in the barrel portion of terminal of FIG. 5.

FIG. 6 shows the terminal blank and FIG. 7 the partially formed terminal 111 in which the first barrel portion 130 has been formed by continuously rolling the first rearward portion into a spiral barrel-shaped portion 130 having the intended interior diameter As indicated by the arrow, first barrel-shaped member 130 portion is to be rolled along the surface of elongated member 63 until lateral edge 124 lies approximately at the axial center line $C_L$ through forward section 136 and second barrel section 162 of the terminal 110 as best seen in FIG. 5. Forming of the terminal 110 of FIG. 8 is completed by rolling the remaining portion of the second or outer barrel member 132 around the circumference of the barrel shaped member 130 such that lateral edge 170 lies approximate the center line of terminal 110 as best seen in FIG. 5. In the spiral wire-receiving barrel member of terminal 110, lateral edges 124 and 170 lie essentially over each other with a continuous strip of metal disposed therebetween. In the formed terminal 110, the first and second transition portions 116, 160 and the first and second contact sections 114 and 136 overlie each other in the same manner as previously described. Further details of the structure of the double barrel construction is found in parent application U. S. Serial No. 07/359,196.

The crimp shown in FIGS. 4 and 8 is disclosed in previously U.S. Pat. 2,535,013. As can be seen in these Figures, the center portion of the respective crimps are plastically deformed preferably below the horizontal axis of the double barrel portions 80, 180 respectively whereby the strands of wire 82 are forced into two sections 84, 86; 184, 186 respectively thereby forming a "B-shaped" crimp of the double barrel portions 80, 180, which further aids in retaining the wire barrels in their crimped position.

The terminal of the present invention may be used with a wide variety of wire sizes. In accordance with the present invention it is preferable that the seam of the outer barrel member would be aligned at the center of the crimped area to maximize the cold welding along the line. A number of materials can be used for making terminals of this type. Preferably the material used has a high conductivity but a low stress relaxation so that a crimp will remain closed over the lifetime of the contact.

The present invention provides a crimpable barrel type terminal member that may be used for power or signal connections. The electrical terminal as disclosed herein and shown in the accompanying figures provides a terminal that can be manufactured in a cost effective stamped and formed manner, permits the use of many grades of materials and combinations of materials so long as the selected material gives the desired amount of conductivity needed for lower termination resistance and has the proper mechanical properties to minimize stress relaxation. The double barrel portion adds bulk to the barrel thus permitting crimping in a manner that is equivalent to a crimping a continuous annular barrel member without the need for welding or brazing and gives a stable crimp with a minimum of constriction resistance. The double transition portion provides a plurality of contact paths thus overcoming problems with the "fuse-like" effect of the prior art.

It is thought the electrical contact terminal of the present invention and many of its intended advantages will be understood from the foregoing description. Changes may be made in the form, construction and arrangement of parts thereof without departing from the spirit and scope of the invention or sacrificing all of its material advantages.

We claim:

1. A wire-receiving barrel terminal comprising:

first and second terminal portions;

said first terminal portion including at least one first contact section, a first transition portion being joined integrally with and extending rearwardly from said at least one first contact section and a first barrel section being joined integrally with and extending rearwardly from said first transition portion;

said second terminal portion including at least one second contact section, a second transition portion being joined integrally with and extending rearwardly from said at least one second contact section and a second barrel section being joined integrally with and extending rearwardly from said second transition portion;

said first barrel section being joined integrally with and extending from said second barrel section, said first and second barrel sections being generally rectangular before being formed, each having at least one lateral edge and a respective lateral dimension at least equal to the circumference of a circle of a desired wire-receiving barrel inner diameter;

said first barrel section being formed into a barrel-shaped member having its axis parallel to said at least one lateral edge of said first barrel section; and said second barrel section being formed circumferentially around and adjacent said first barrel section, said barrel sections defining a wire receiving barrel having inner and outer walls, each said at least one lateral edge of said first and second barrel sections being disposed along a continuous wall portion of said second or first barrel section respectively such that said first contact section and said first transition portion extend along said second contact section and said second transition portion respectively with said first contact section adjacent and overlying said second contact section, said first and second contact sections being adapted to be connected to a first electrical article; whereby the wire-receiving barrel has substantially two wall thicknesses circumferentially therearound with no open seam and said two transition portions provide a plurality of contact paths for current passed through said terminal.

2. The terminal of claim 1 wherein said first and second terminal portions are joined integrally with and extend from a bight section, said bight section extending rearwardly from and between respective rearward edges of said first and second barrel sections, said bight section being bent back upon itself such that said first and second terminal portions extend along one another.

3. The terminal of claim 1 wherein said first and second contact sections have different geometric configurations.

4. The terminal of claim 3 wherein said second contact section is an annular member having a plurality of spring sections extending therearound.

* * * * *